US006570994B1

(12) United States Patent
Berthoud et al.

(10) Patent No.: US 6,570,994 B1
(45) Date of Patent: May 27, 2003

(54) FIELD LAYER SPEAKER FOR CONSUMER PRODUCTS

(75) Inventors: Charles William Berthoud, Nazareth, PA (US); Bradley M. Feick, Stony Creek, PA (US); James Skorko, Allentown, PA (US)

(73) Assignee: Agere Systems Inc., Allentown, PA (US)

( * ) Notice: Subject to any disclaimer, the term of this patent is extended or adjusted under 35 U.S.C. 154(b) by 0 days.

(21) Appl. No.: 09/276,155

(22) Filed: Mar. 25, 1999

(51) Int. Cl.[7] ..... H04R 25/00

(52) U.S. Cl. ..... 381/423; 381/396; 340/407.1; 361/782; 361/803

(58) Field of Search ..... 379/364, 418, 379/433, 368, 369, 370; 455/90, 38.2, 567; 340/407.1, 407.2, 7.6; 310/81, 268; 381/408, 344; 361/781–782, 792–795, 680, 803; 336/200, 232

(56) References Cited

U.S. PATENT DOCUMENTS 4,194,097 A * 3/1980 Bradam ..... 200/5 A
4,286,129 A * 8/1981 Petit ..... 200/513
4,314,112 A * 2/1982 Misson et al.
5,175,459 A * 12/1992 Danial et al. ..... 310/81
5,396,264 A * 3/1995 Falcone et al. ..... 340/7.55
5,524,061 A * 6/1996 Mooney et al. ..... 381/151
5,583,474 A * 12/1996 Mizoguchi et al. ..... 336/83
5,801,521 A * 9/1998 Mizoguchi et al. ..... 323/282
5,825,297 A * 10/1998 Mooney et al. ..... 116/204
5,883,612 A * 3/1999 Kreitzer ..... 340/7.55
5,914,481 A * 6/1999 Danielson et al. ..... 235/472
5,956,622 A * 9/1999 Lee ..... 455/38.2
5,959,522 A * 9/1999 Andrews ..... 336/200
5,978,231 A * 11/1999 Tohya et al. ..... 174/262
6,008,714 A * 12/1999 Okuda et al. ..... 335/221
6,057,753 A * 5/2000 Myers ..... 340/407.1
6,160,489 A * 12/2000 Perry et al. ..... 340/825.44
6,324,067 B1 * 11/2001 Nishiyama ..... 174/262
6,404,317 B1 * 6/2002 Mizoguchi et al. ..... 336/200

* cited by examiner

*Primary Examiner*—Rexford Barnie
*Assistant Examiner*—P. Dabney
(74) *Attorney, Agent, or Firm*—William H. Bollman

(57) ABSTRACT

A technique and apparatus for integrating a speaker with button (or keyboard) components such as a tactile membrane and/or PCB. The tactile membrane conventionally used between buttons and switch mechanisms to provide tactile feedback to a user upon depression of the button is extended to form a vibrating portion of a speaker. The vibrating portion is doped with or otherwise includes an activating material (e.g., copper) which will be physically affected by a magnetic field. The activating material may be adhered to the upper and/or lower side of the vibrating portion, or doped therein. A coil for the speaker is formed with a coil tracing pattern formed on one or more layers of a PCB. One or more amplifier circuits may be included to drive one or more coil patterns, to cause a fluctuating magnetic field in the direction perpendicular to the vibrating portion of the tactile membrane. The vibrating portion of the tactile membrane responds to the fluctuations in the magnetic field, causing audible sounds to be output.

17 Claims, 6 Drawing Sheets

FIELD LAYER SPEAKER FOR CONSUMER PRODUCTS

BACKGROUND OF THE INVENTION

1. Field of the Invention

This invention relates generally to speakers in consumer products. More particularly, it relates to the integration of a speaker with a keypad using a common membrane and/or printed circuit board.

2. Background of Related Art

Speakers and keypads are found in many consumer products, particularly in telecommunications related devices. For instance, telephone answer devices typically include a twelve (12) key alphanumeric keypad for dialing telephone numbers, and a speaker for playing back recorded voice messages. Similarly, speakerphones include an alphanumeric keypad for dialing telephone numbers, and a speaker for outputting received voice signals from a telephone line. Facsimile machines include an alphanumeric keypad for dialing telephone numbers and a speaker to provide audible monitoring of an outgoing telephone call.

Other devices other than telecommunications related devices include buttons and speakers. For instance, small, inexpensive radios include buttons for tuning, power control, etc., and a speaker for outputting the received audible radio signal. Telecommunications related or not, the types of devices including at least one PCB mounted button and speaker are endless.

In higher end consumer devices, quality speakers are used. However, in lower end consumer devices, and in higher end consumer devices which rarely or insignificantly output audible sounds through their speaker, a quality speaker may be overkill and wasteful of costs.

In many conventional devices, the buttons are mounted on a printed circuit board (PCB), which provides an efficient and inexpensive method of wiring the buttons to a processor or other device. In smaller devices, the processor may be mounted on the same PCB as the buttons, and in larger devices the processor may be mounted on a separate PCB but in wired communication with the button PCB. In any event, the speaker is typically mounted in a common chassis with the button PCB.

The conventional speaker is electrically connected to the button PCB or other PCB with two wires extending from the coil of the speaker to corresponding solder pads or through holes on the button PCB or other PCB. Unfortunately, it is manually intensive not only to separately mount both the speaker and button PCB, but also to solder the two wires between the coil of the speaker and a corresponding PCB. Moreover, if the speaker is not mounted in close proximity to the PCB, the wires may require strapping to secure them against breakage and to allow easy access to components surrounding the speaker.

For instance, FIG. 6 shows a conventional device 650 including both a speaker 600 and a plurality of buttons 190 mounted on a printed circuit board (PCB) 160.

In particular, a conventional speaker 600 is mounted in close proximity to the buttons 190, with two speaker wires 604, 606 providing electrical connection between the coil of the speaker 600 and the wiring on the PCB 160.

Conventional buttons 190 come in many shapes and sizes. For instance, the buttons 190 shown in FIG. 6 include button caps 191, a tactile layer 170 including a respective plurality of tactile portions 190*a* corresponding to each button cap 191. The buttons 190 also include an electrical switch 192. The electrical switch 192 may be, e.g., as simple as conductive rubber causing conduction between two exposed wire traces on the PCB 160, or may be comprised of a more rugged mechanical switching mechanism.

Although not shown, PCB mount speakers are available. However, PCB mount speakers are typically costly, and often capable of outputting audible signals at a quality much higher than that required by the particular application. Thus, in low end devices or in high end devices making minimal quality use of the speaker, a PCB mount speaker is nevertheless overkill and wasteful of costs.

There is a need for a more cost effective speaker solution for consumer devices including buttons together with the speaker.

SUMMARY OF THE INVENTION

In accordance with the principles of the present invention, a speaker comprises a tactile member for a button including an active region responsive to fluctuations in a magnetic field. A coil, formed on a printed circuit board, is adapted to create a fluctuating magnetic field at the active region of the tactile member.

In accordance with another aspect of the present invention, a method of forming a speaker for a consumer product comprises forming a vibrating portion of the speaker from an extension of a tactile member of a button. An active region is included in the vibrating portion, the active region being attracted and repelled by fluctuations in a magnetic field. A coil is formed adjacent to the active region to create the magnetic field.

BRIEF DESCRIPTION OF THE DRAWINGS

Features and advantages of the present invention will become apparent to those skilled in the art from the following description with reference to the drawings, in which.

DETAILED DESCRIPTION OF ILLUSTRATIVE EMBODIMENTS

The present invention provides a low cost technique and apparatus for integrating a speaker with button (or keyboard)

components, preferably using elements used with respect to the buttons and corresponding switches, and eliminating the need to separately wire the speaker.

In accordance with the principles of the present invention, tactile membrane used between buttons and switch mechanisms to conventionally provide tactile feedback to a user upon depression of the button is extended to include a vibrating portion. The vibrating portion is doped with or otherwise includes a material (e.g., copper) which will be physically affected by a magnetic field. The button printed circuit board is also extended to include a tracing forming a coil of the speaker.

Appropriate circuitry may be included on the same or a different PCB to drive the coil and cause a fluctuating magnetic field in the direction toward the vibrating portion of the tactile membrane. The vibrating portion of the tactile membrane responds to the fluctuations in the magnetic field, causing audible sounds to be output.

A field layer speaker in accordance with the principles of the present invention may be used in devices having minimal requirements for audible sound quality.

Figure 1:
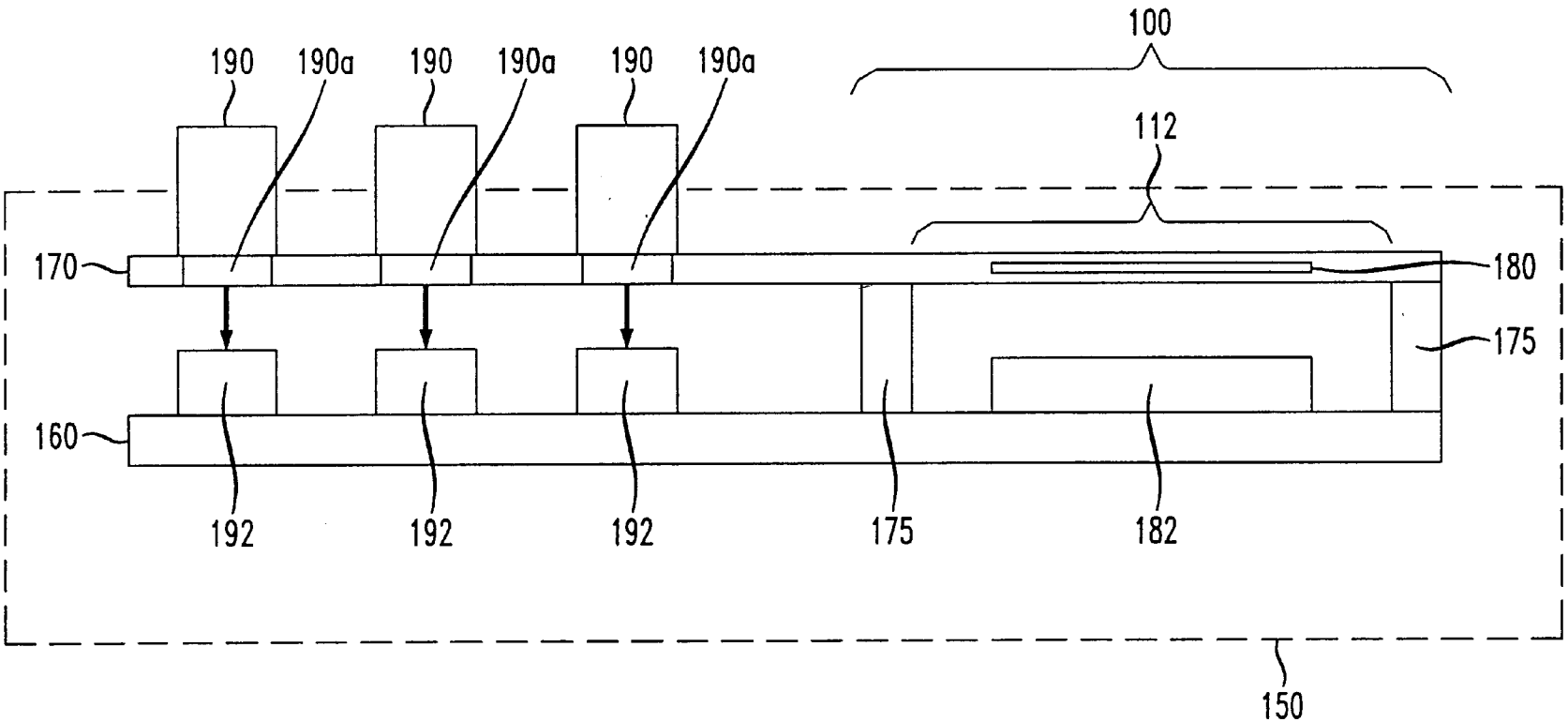
FIG. 1 is a cross sectional view of an embodiment of a field layer speaker integrated with a button PCB, in accordance with the principles of the present invention.

FIG. 1 is a cross sectional view of an embodiment of a field layer speaker integrated with a button PCB, in accordance with the principles of the present invention.

In particular, FIG. 1 shows a field layer speaker 100 formed from an extension of the tactile member 170 and PCB 160 used by the buttons 190 and corresponding switches 192. In the disclosed embodiment, the tactile member 170 is preferably a poly material. However, other suitable and conventional materials used as tactile members can be used, e.g., a non-magnetic metallic layer.

The vibrating portion of the tactile member 170 is doped with a material affected by a magnetic field (e.g., copper) in an active region 180.

The vibrating portion 112 is terminated in the disclosed embodiment with rubberized damping members 175. The damping members 175 may also provide support and separation between the tactile member 170 and the PCB 160.

Figure 2:
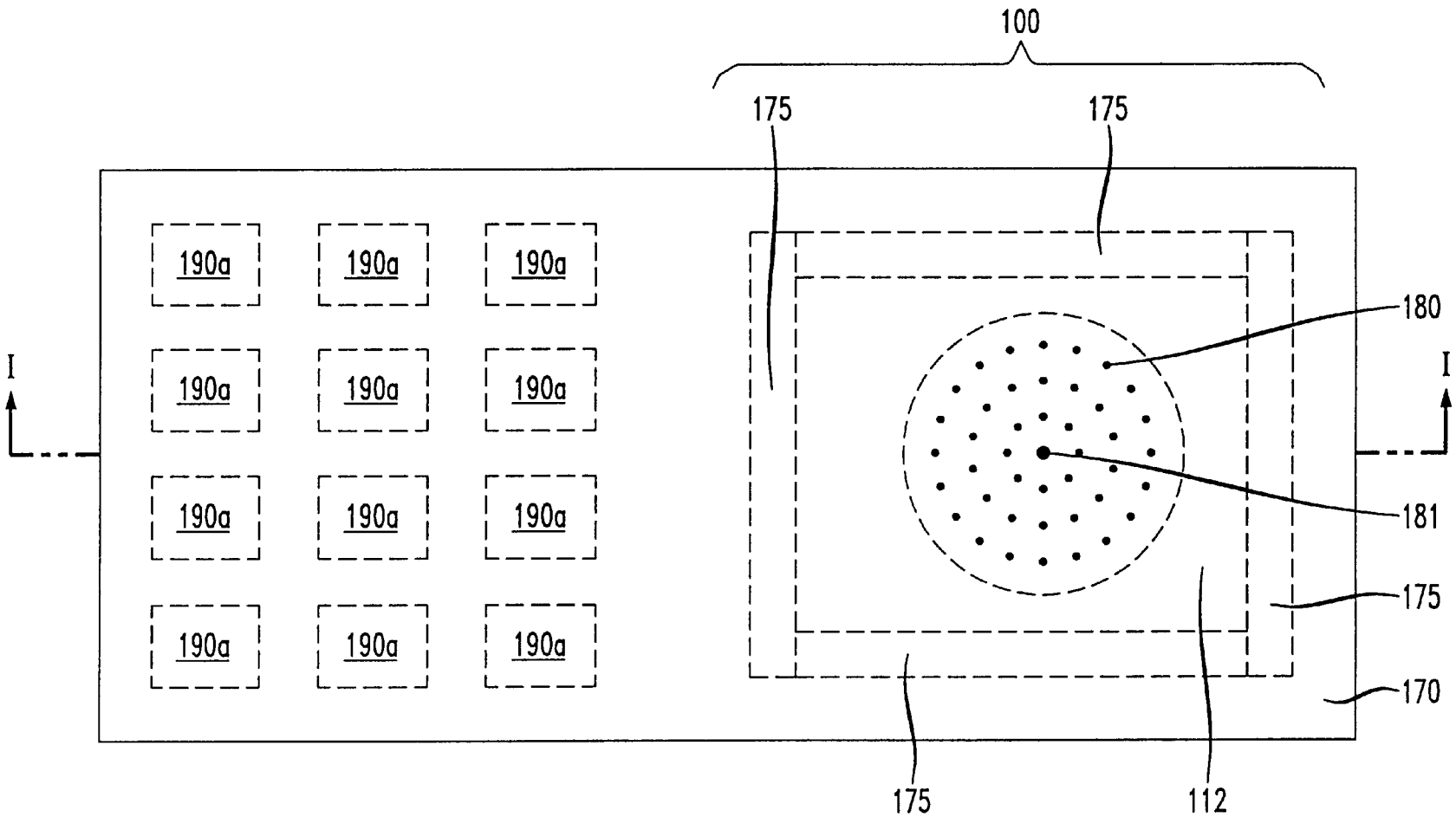
FIG. 2 is a top view of an exemplary membrane layer between the button caps and their corresponding switches, extended to form a vibrating layer for a field layer speaker as shown in FIG. 1.

The damping members 175 may form any appropriate pattern about the perimeter of the vibrating portion 112. For instance, the damping members 175 may form a square vibrating portion 112 as shown in FIG. 2. Alternatively, the damping members 175 may form a circular or oval shaped vibrating portion, a polygonal-shaped vibrating portion, or even a non-symmetrical vibrating portion.

While the damping members 175 are preferred to avoid affects of the vibration of the vibrating portion 112 on the operation of the buttons 190 and corresponding switches 192, the damping members 175 may be eliminated in appropriate applications, e.g., if the vibrating portion 112 is formed of a member separate from the tactile member of the buttons 190.

The PCB 160 includes a tracing pattern forming a coil 182 proximate to the active region 180 of the vibrating portion 112. The tracing pattern is preferably formed in a flat plane and with a thickness corresponding to other portions of wiring on the PCB 160. However, to provide thickness to the coil 182, separate portions of the coil may be formed on separate layers of the PCB 160. For instance, if a four layer PCB is used, the coil 182 may be formed by spiral portions formed on each of the four layers, to collectively form a magnetic field to appropriately attract and repel the active region 180 of the vibrating portion 112 in correspondence with a signal to be output from the speaker 100. Alternatively, the multiple coil layer can be individually energized to provide a more intricate magnetic field with respect to the vibrating portion 112.

FIG. 2 is a top view of an exemplary membrane layer between the button caps and their corresponding switches, extended to form a vibrating layer for a field layer speaker as shown in FIG. 1.

In particular, the tactile member 170 is extended to form the vibrating portion 112 of the speaker 100 in a region surrounded by the damping members 175. The active region 180 is shown as an appropriately sized doped copper material formed within the thickness of the tactile member 170.

Alternatively, or additionally, the active region 180 may be formed by adhesion of an active material such as copper (or other suitable material which reacts to a generated field) on an upper and/or lower surface of the active region 180.

The active material may be in granular form, or may be formed in a continuous, planar layer. For instance, an insulated spiral or other shaped coil of copper may be isolated in or on the active region 180 of the vibrating portion 112.

Figure 3:
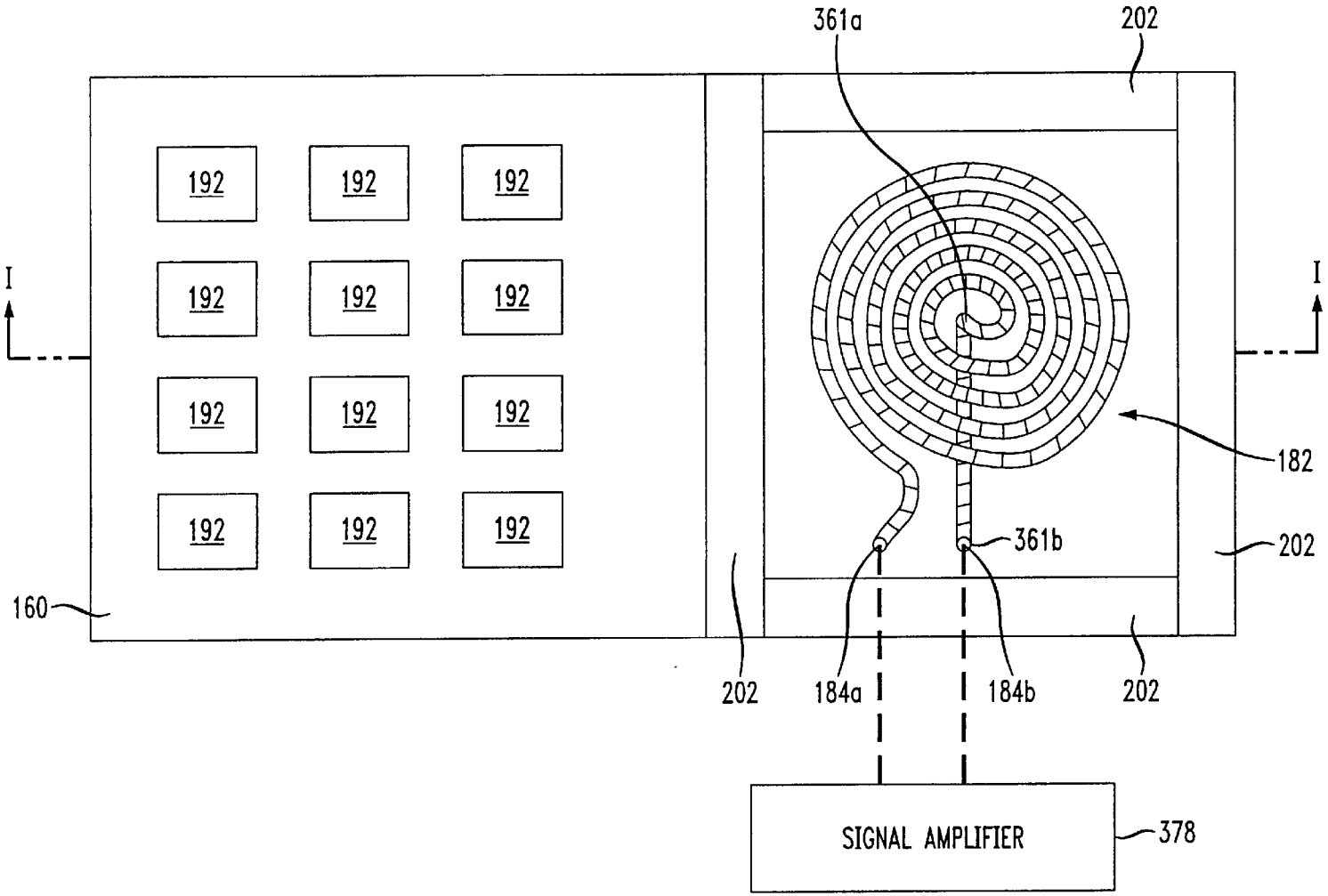
FIG. 3 is a top view of a first embodiment of a printed circuit board shown in FIG. 1, extended to include a spiral coil using two layers of the printed circuit board, for creating a magnetic field to cause vibration of a corresponding vibrating layer of the field layer speaker, in accordance with the principles of the present invention.

FIG. 3 is a top view of a first embodiment of the printed circuit board 160 shown in FIG. 1, extended to include a spiral-shaped coil 182 using two layers of the printed circuit board 160. The spiral-shaped coil 182 is driven by appropriate circuitry (such as a signal amplifier 378) to create a fluctuating magnetic field to cause vibration of a corresponding vibrating layer of the field layer speaker, in accordance with the principles of the present invention.

In particular, FIG. 3 shows a spiral-shaped coil 182 formed on an upper layer of the PCB 160, and a return wire from the center of the coil 182 on a second layer of the PCB 160, with appropriate via holes 361*a*, 361*b* formed in the PCB 160. Preferably, the symmetrical center of the coil 182 is arranged coaxial to the symmetrical center of the active region 180 of the approximate vibrating portion 112 of the tactile member 170.

If the PCB 160 has more than two layers available, multiple spiral- or other-shaped coils 182 may be formed on the various layers of the PCB 160 to individually or collectively create the desired magnetic field for attracting and repelling the active region 180 of the vibrating portion 112 of the speaker 100 to create the desired audible output. When multiple coil patterns are used, the patterns are preferably arranged coaxial to one another. However, the multiple coils may be arranged such that each coil is intended to mostly affect a separate region of the active portion 180.

Generally, the center 181 of the vibrating portion 112 travels the farthest toward and away from the coil 182, and thus the magnetic field fluctuations should be the greatest at a point at the center of the active region 180.

FIG. 3 also shows the use of damping members 202 around a perimeter of the tactile member to allow a larger area of the tactile member 170 (FIGS. 1 and 2) to vibrate.

Figure 4:
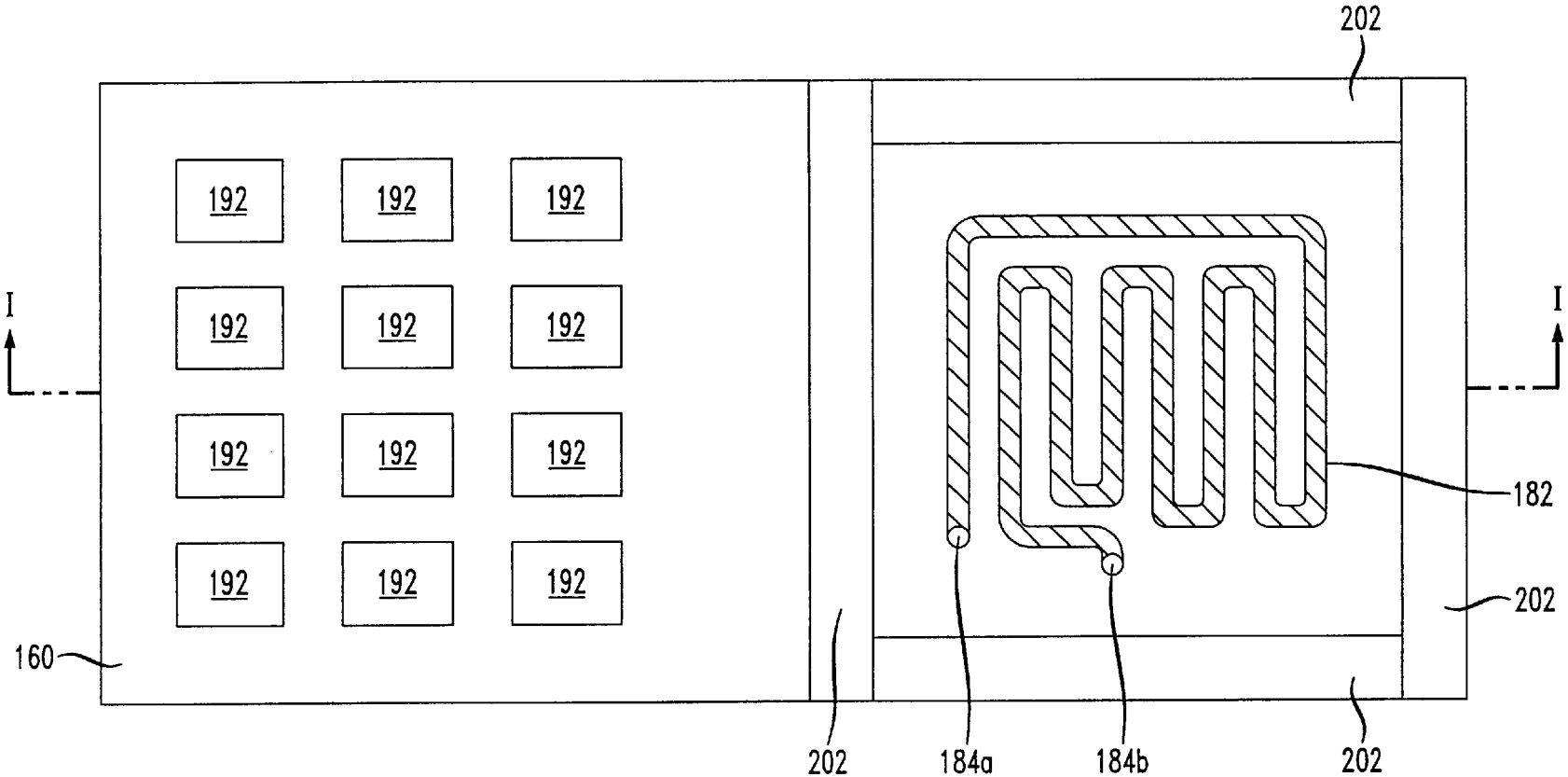
FIG. 4 is a top view of another embodiment of the printed circuit board shown in FIG. 1, extended to include a square shaped coil, for creating a magnetic field to cause vibration of a corresponding vibrating layer of the field layer speaker, in accordance with the principles of the present invention.

FIG. 4 is a top view of another embodiment of the printed circuit board 160 shown in FIG. 1, extended to include a square shaped coil 182. The square shaped coil 182, when appropriately driven with an amplified signal, creates a magnetic field to cause vibration of a corresponding vibrating portion 112 of the speaker 100, in accordance with the principles of the present invention.

As shown in FIG. 4, the square shaped coil 182 can be formed on a single wiring layer of the PCB 160. Of course, the coil 182 can be formed on any number of layers of the PCB 160 in accordance with the principles of the present invention. Moreover, multiple coil patterns (and shapes) can be combined in various ways to create the desired fluctuating magnetic field to drive the active region 180 of the vibrating portion 112. For instance, a first PCB layer may include a square shaped coil 182 as shown in FIG. 4, a second PCB layer may include another square shaped coil 182 as shown in FIG. 4, and third and fourth PCB layers may include a spiral shaped coil 182 as shown in FIG. 3.

When multiple coil patterns are used, each coil may selectively be separately driven from a separate amplifier. The separate amplifiers are preferably tuned based on the corresponding coils' and/or vibrating portion's 112 characteristics, e.g., shape, distance from active region 180, impedance, linearity, etc. Of course, all coil patterns may be driven by the same amplifier or signal, either in parallel or in series, in accordance with the principles of the present invention.

Figure 5:
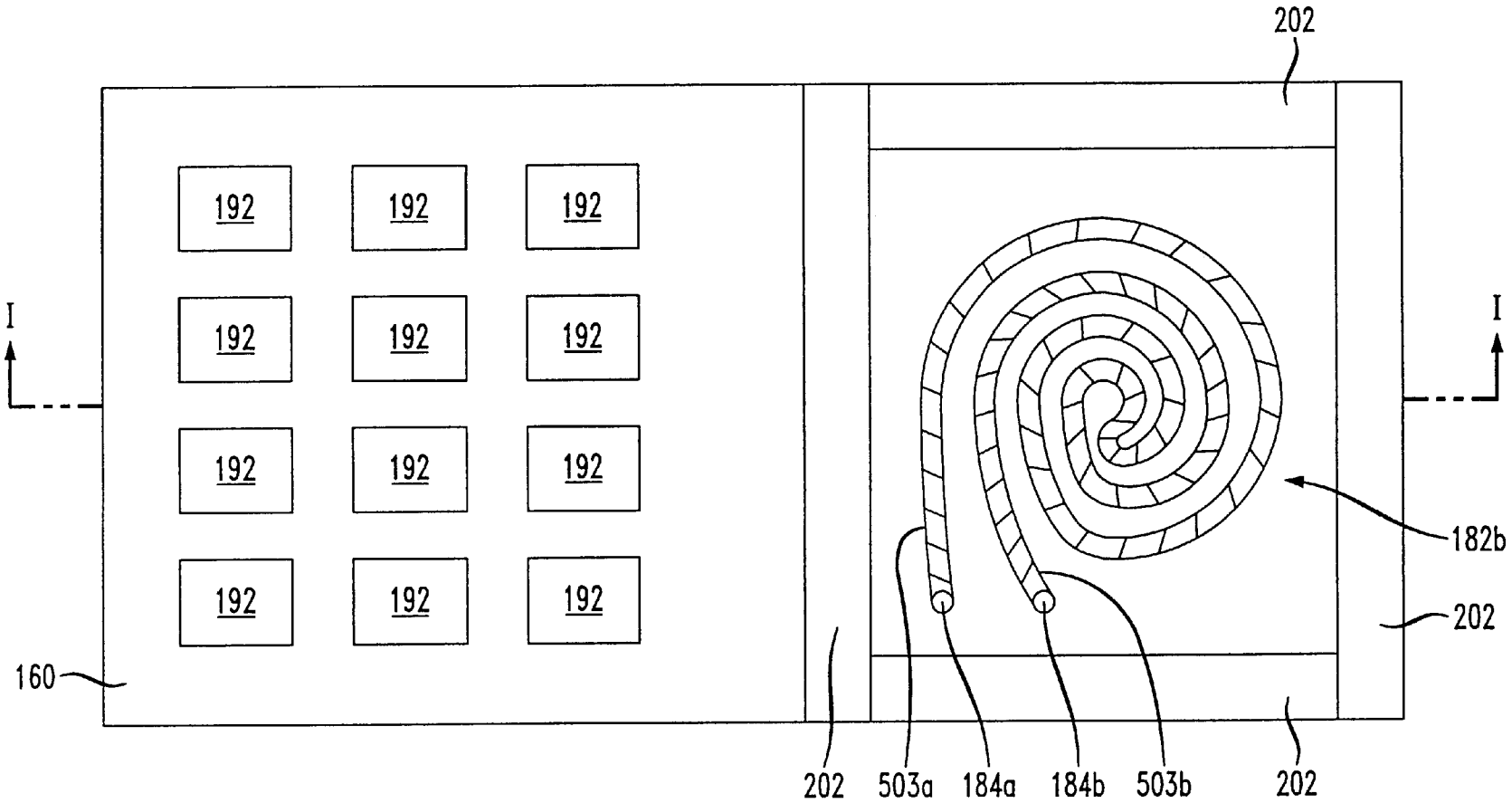
FIG. 5 is a top view of a first embodiment of a printed circuit board shown in FIG. 1, extended to include a spiral shaped coil using one side of the printed circuit board, for creating a magnetic field to cause vibration of a corresponding vibrating layer of the field layer speaker, in accordance with the principles of the present invention.
Figure 6:
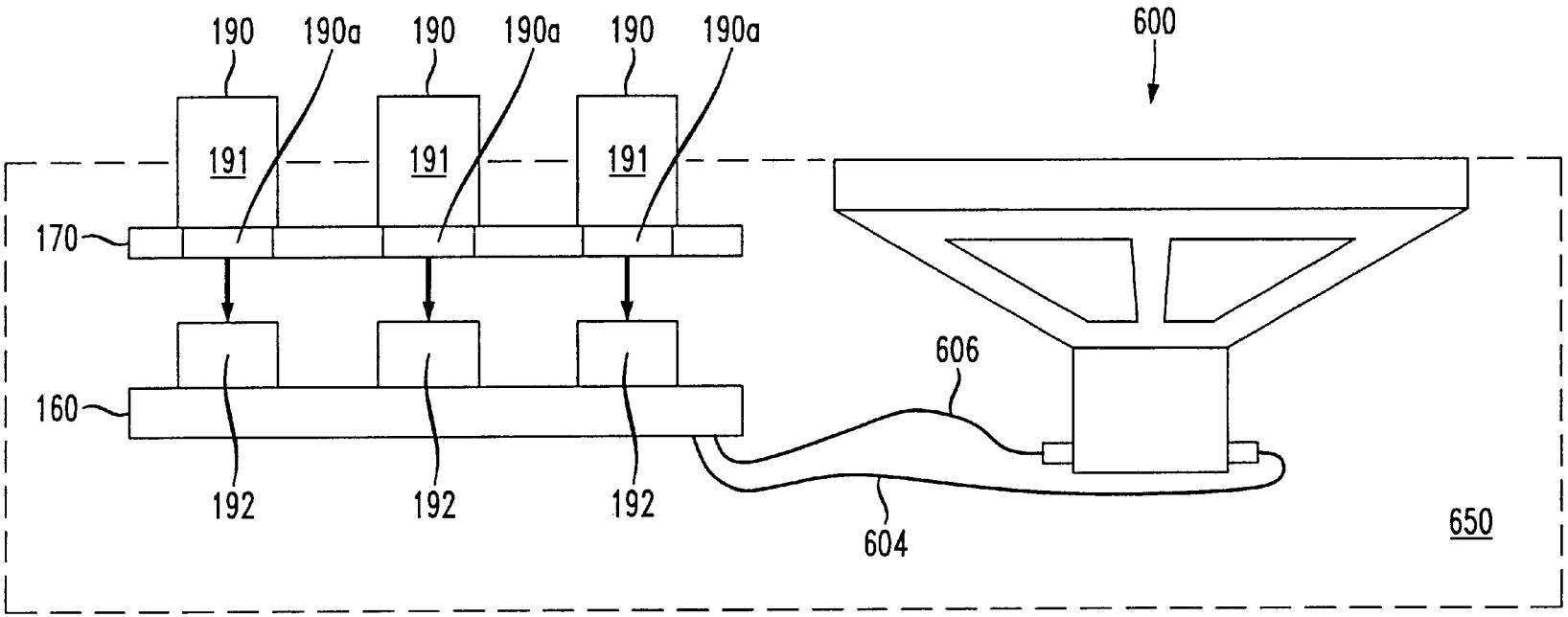
FIG. 6 PRIOR ART
FIG. 6 shows a conventional device including both a speaker and a plurality of buttons mounted on a printed circuit board.

FIG. 5 is a top view of yet another embodiment of the printed circuit board 160 shown in FIG. 1, extended to include a spiral shaped coil using only one side of the printed circuit board 160. The single-sided spiral shaped coil, when appropriately driven with a signal, creates a fluctuating magnetic field to cause vibration of the vibrating portion 112, in accordance with the principles of the present invention.

In particular, the single-sided coil 182 formed on one side of the PCB 160 includes an outgoing wiring route 503*a* and an incoming wiring route 503*b* as it spirals toward its symmetrical center.

While the invention has been described with reference to the exemplary embodiments thereof, those skilled in the art will be able to make various modifications to the described embodiments of the invention without departing from the true spirit and scope of the invention.

What is claimed is:

1. A speaker, comprising:

a tactile member adapted to be attached to a button and including an active region responsive to fluctuations in a magnetic field; and a coil formed on a printed circuit board, said coil being adapted to create a fluctuating magnetic field at said active region of said tactile member to produce from said speaker an audible sound originally generated by a separate source.

2. The speaker according to claim 1, wherein:

said coil is spiral-shaped.

3. The speaker according to claim 1, wherein:

said coil is primarily polygonal-shaped.

4. The speaker according to claim 1, wherein:

said coil is formed on one layer of said printed circuit board.

5. The speaker according to claim 1, wherein:

said coil is formed on a plurality of layers of said printed circuit board.

6. The speaker according to claim 1, wherein said coil comprises:

a plurality of coil patterns formed on separate layers of said printed circuit board.

7. The speaker according to claim 1, wherein:

an amplifier circuit is used to drive said coil and cause said tactile member to vibrate in an area including said active region.

8. The speaker according to claim 1, further comprising:

at least one button and corresponding switch.

9. A speaker, comprising:

a tactile member adapted to be attached to a button and including an active region responsive to fluctuations in a magnetic field;

a coil formed on a printed circuit board, said coil being adapted to create a fluctuating magnetic field at said active region of said tactile member to produce from said speaker an audible sound origianlly generated by a separate source; and a keypad formed from at least one of said tactile member and said printed circuit board.

10. The speaker according to claim 9, wherein:

said keypad is an alphanumeric keypad.

11. The speaker according to claim 10, wherein:

said keypad includes at least twelve buttons.

12. A method of forming a speaker, said method comprising:

forming a vibrating portion of said speaker from an extension of a tactile member adapted to be attached to a button to produce from said speaker an audible sound originally generated by a separate source;

including an active region in said vibrating portion, said active region being attracted and repelled by fluctuations in a field; and forming a coil on a printed circuit board proximate to said active region to create said magnetic field.

13. The method of forming a speaker according to claim 12, wherein:

said coil is formed on at least one layer of a printed circuit board.

14. A method of forming a speaker, said method comprising:

forming a vibrating portion of said speaker from an extension of a tactile member adapted to be attached to a button;

including an active region in said vibrating portion, said active region being attracted and repelled by fluctuations in a magnetic field;

forming a coil on a printed circuit board proximate to said active region to create said magnetic field; and providing a button on said tactile member.

15. A consumer product including a speaker comprising:

vibrating portion means of said speaker formed from an extended tactile member adapted to be attached to a button for producing from said speaker an audible sound originally generated by a separate source;

active region means, in said vibrating portion, for being attracted and repelled by fluctuations in a magnetic field; and coil means, proximate to said active region, for creating said magnetic field.

16. The speaker according to claim 15, wherein:

said coil means is formed on at least one layer of a printed circuit board.

17. A consumer product including a speaker, comprising:

vibrating portion means formed from an extended tactile member adapted to be attached to a button;

active region means, in said vibrating portion, for being attracted and repelled by fluctuations in a magnetic field;

coil means, proximate to said active region, for creating said magnetic field; and button means on said tactile member.

* * * * *